US005902450A

United States Patent [19]

Jones

[11] Patent Number: 5,902,450

[45] Date of Patent: May 11, 1999

[54] APPARATUS FOR APPLYING LABELS TO MOVING ARTICLES

[75] Inventor: Timothy John Jones, Banbury, United Kingdom

[73] Assignee: Labfax Systems Limited, Shropshire, United Kingdom

[21] Appl. No.: 08/809,907

[22] PCT Filed: Sep. 22, 1995

[86] PCT No.: PCT/GB95/02271

§ 371 Date: May 30, 1997

§ 102(e) Date: May 30, 1997

[87] PCT Pub. No.: WO96/09212

PCT Pub. Date: Mar. 28, 1996

[30] Foreign Application Priority Data

Sep. 23, 1994 [GB] United Kingdom ..... 9419289

[51] Int. Cl.[6] ..... B65C 9/00

[52] U.S. Cl. ..... 156/542; 156/556; 156/568; 156/571

[58] Field of Search ..... 156/542, 566, 156/567, 568, 571, 572, DIG. 31, 556

[56] References Cited

U.S. PATENT DOCUMENTS 4,293,365 10/1981 Geyser et al. .
4,561,921 12/1985 Treiber ..... 156/542
4,574,027 3/1986 Weinündbrot .
4,767,487 8/1988 Tomsovic, Jr. ..... 156/571 X
5,019,207 5/1991 McCoy ..... 156/571
5,221,405 6/1993 Trouteaud ..... 156/572 X

OTHER PUBLICATIONS

English translation of European Patent No. 0 608 296 which resulted from Publication WO 93/08081 dated Apr. 29, 1993.

*Primary Examiner*—James Engel
*Attorney, Agent, or Firm*—Flynn, Thiel, Boutell & Tanis, P.C.

[57] ABSTRACT

An apparatus for applying adhesive labels to the rear of articles on a moving conveyor. Two arms are mounted on a gantry spanning the conveyor. Each arm has an inner arm portion mounted on a shaft which is rotated by a motor and transmission, always in the same direction, under the control of a computer having an input from a sensor for detecting the rear edge of each article. Each arm has an outer arm portion pivotably connected to the inner arm portion and urged to a generally straight position by a torsion spring. Each outer arm carries a label-applying pad which is extended by an actuator to collect a label from a printer above the gantry and then retracted as the arm rotates in response to detection of a package.

17 Claims, 6 Drawing Sheets

IV
V
31
32
24
60
30
25
22
23
29
26
33
17
20
62
44
8
15
43
34
42
9
11
10
IV

L
C
R
B
A

L
B

L

L

L

R
L

C

APPARATUS FOR APPLYING LABELS TO MOVING ARTICLES

FIELD OF THE INVENTION

This invention relates to an apparatus for applying adhesive-carrying labels to articles which are moved past the apparatus, for example on a moving conveyor.

SUMMARY OF THE INVENTION

The apparatus according to the present invention comprises an arm mounted for rotation about an axis transverse to the direction of movement of the articles, a label support on the arm for releasably supporting a label and carrying the label along a path to bring the label into contact with an article to be labelled, the label support being yieldably mounted relative to the inner part of the arm.

Advantageously, the arm is articulated with a resilient bias towards a straight configuration but resiliently yieldable when applying a label to an article.

Advantageously, the labels are self-adhesive labels carried by a release tape at a supply point which may include a printer for printing required indicia on the labels. The arm is preferably extendible and has means for extending the label support to collect a label at the supply point and then to retract the label support clear of the supply point. The extending means may comprise a pneumatic actuator actuated through rotary joints on the axis of rotation of the arm. The apparatus may include two arms mounted for rotation about a common axis and arranged to alternate in collecting and applying labels. In order to reduce the number of rotary air-supply joints required, each arm may carry a two-position pilot valve, the state of which may be changed by the supply of pressurized air, via a respective rotary joint, this supply also being connected by a flexible conduit to a part of the pilot valve on the other arm. The arrangement is such that when both supplies are pressurized, both label supports are retracted, but when one supply is depressurized, the associated pilot valve operates to apply pressure from the other supply to extend the label support associated with the said one supply means.

Preferably, each label support holds successive labels by suction (applied via a rotary connection at the axis of rotation of the respective arm), which suction is replaced by positive pressure as the label is applied to an article.

BRIEF DESCRIPTION OF THE DRAWINGS

An embodiment of the invention will now be described by way of example with reference to the accompanying drawings, in which.

DETAILED DESCRIPTIONS

Figure 1:
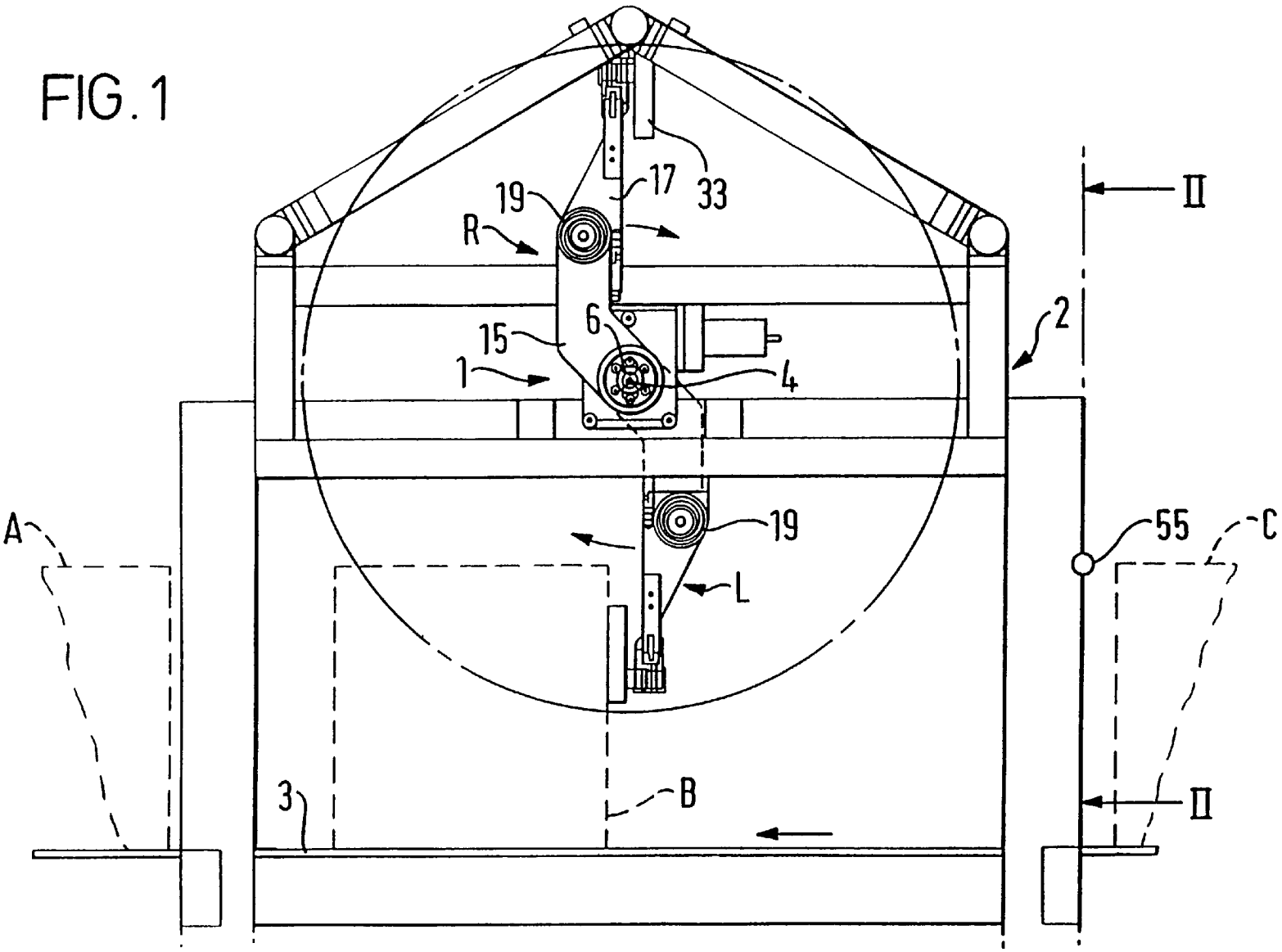
FIG. 1 is a vertical elevational view of labelling apparatus in accordance with the invention mounted about a conveyor, as seen from one side of the conveyor.
Figure 2:
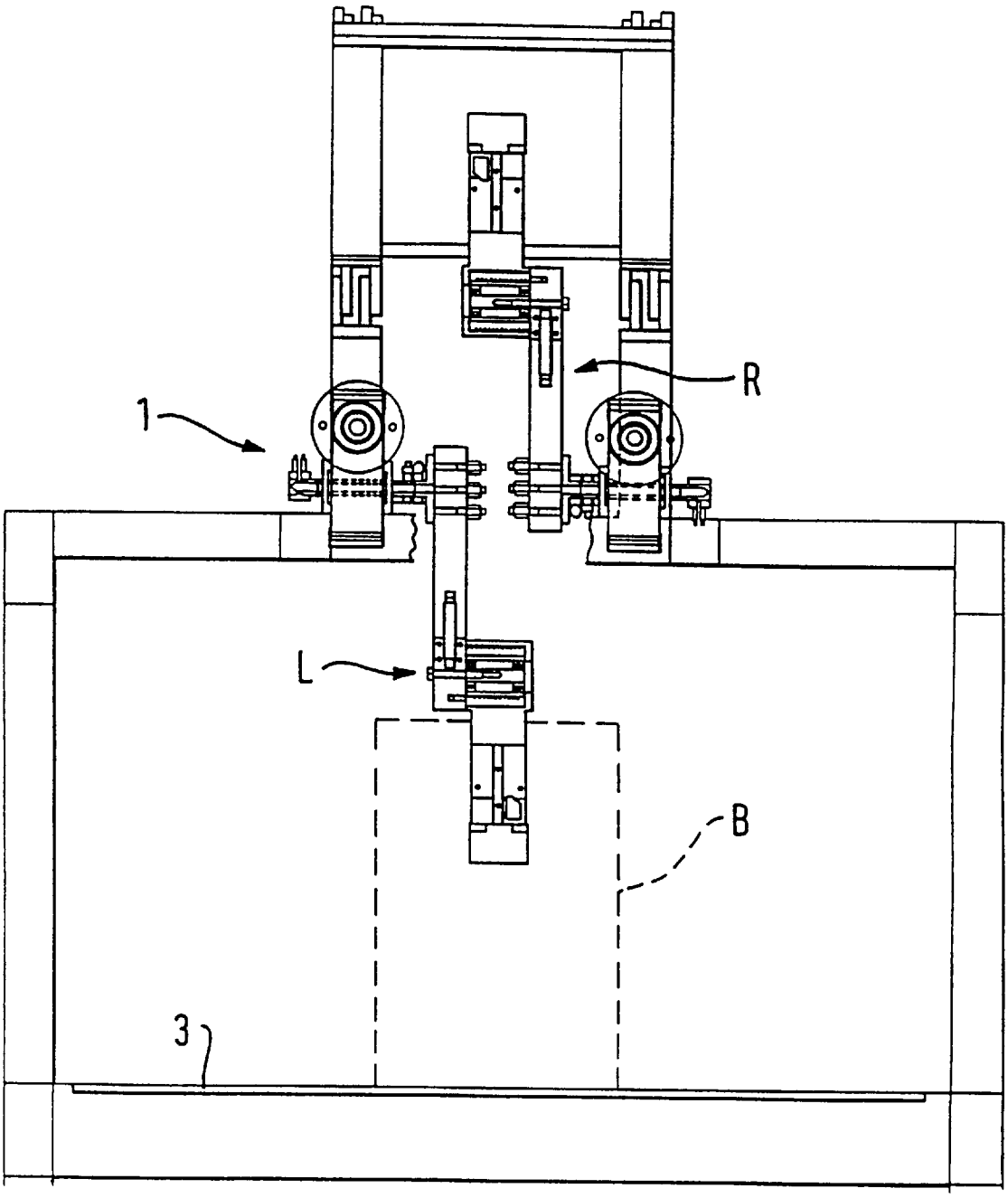
FIG. 2 is a vertical section generally on the line II—II of FIG. 1.

As shown in FIGS. 1 and 2, the labelling apparatus 1 is mounted on a gantry frame 2 spanning a conveyor 3 along which successive packages A, B, C, for example from a packaging machine (not shown) are being moved under the apparatus 1. The packages A, B, C have substantially the same dimensions but are not necessarily spaced at equal intervals along the conveyor.

The apparatus comprises two substantially identical arms L and R capable of being rotated about a common horizontal axis 4 indefinitely but at variable speeds.

The arms L, R are articulated and mounted on respective shafts 6 supported in bearings 7 in a gearbox housing 8 for each arm. Each shaft 6 is driven, always in the same direction but at variable speed, by a brushless DC motor 9 (FIG. 3) via a toothed belt and pulley reduction transmission 10 and a worm shaft 11, the worm 12 of which meshes with a worm wheel 13 secured to the shaft 6.

Each arm L, R is formed by an inner arm portion 15, the outer end part of which carries a bolt 16 on which an outer arm portion 17 is mounted by bearings 18. A coiled torsion spring 19 has one end 20 anchored in the inner arm portion 15 and its other end anchored in the outer arm portion 17 and is prestressed to urge the outer arm portion 17 to the position, relative to the inner arm portion 15, shown in FIG. 3, but to allow relative movement of the outer arm portion 17 in the direction of the arrow 22 in FIG. 3.

The outer arm portion 17 is extendible and for this purpose has a rectangular-section portion 23 on which a head portion 24 is slidable, having a correspondingly shaped space 25 there within. Movement of the head portion 24 is effected by a pneumatic actuator 26 located within the portion 23 and having pneumatic connections 27 and 28 leading to opposite sides of the piston 29 of the actuator.

The head portion 24 carries a bolt 30 on which a label support 32 can swivel, by means of bearings 31. The support 32 includes a label-carrying pad 33 formed by a perforated or porous plastic plate to which suction can be applied from a flexible line 34.

Between the hub of the inner arm portion 15 and the casing of the gearbox 8, the shaft 6 passes through a double rotary connector 36, 37 comprising three rotary seals, the two spaces between adjacent seals being connected respectively to a suction line 38 and an actuator supply line 39. Passages 40, 41 within the shaft 6 lead from openings communicating with the two respective spaces between the seals, to the line 34 and to a connector 42 on the inner arm portion 15.

Figure 7:
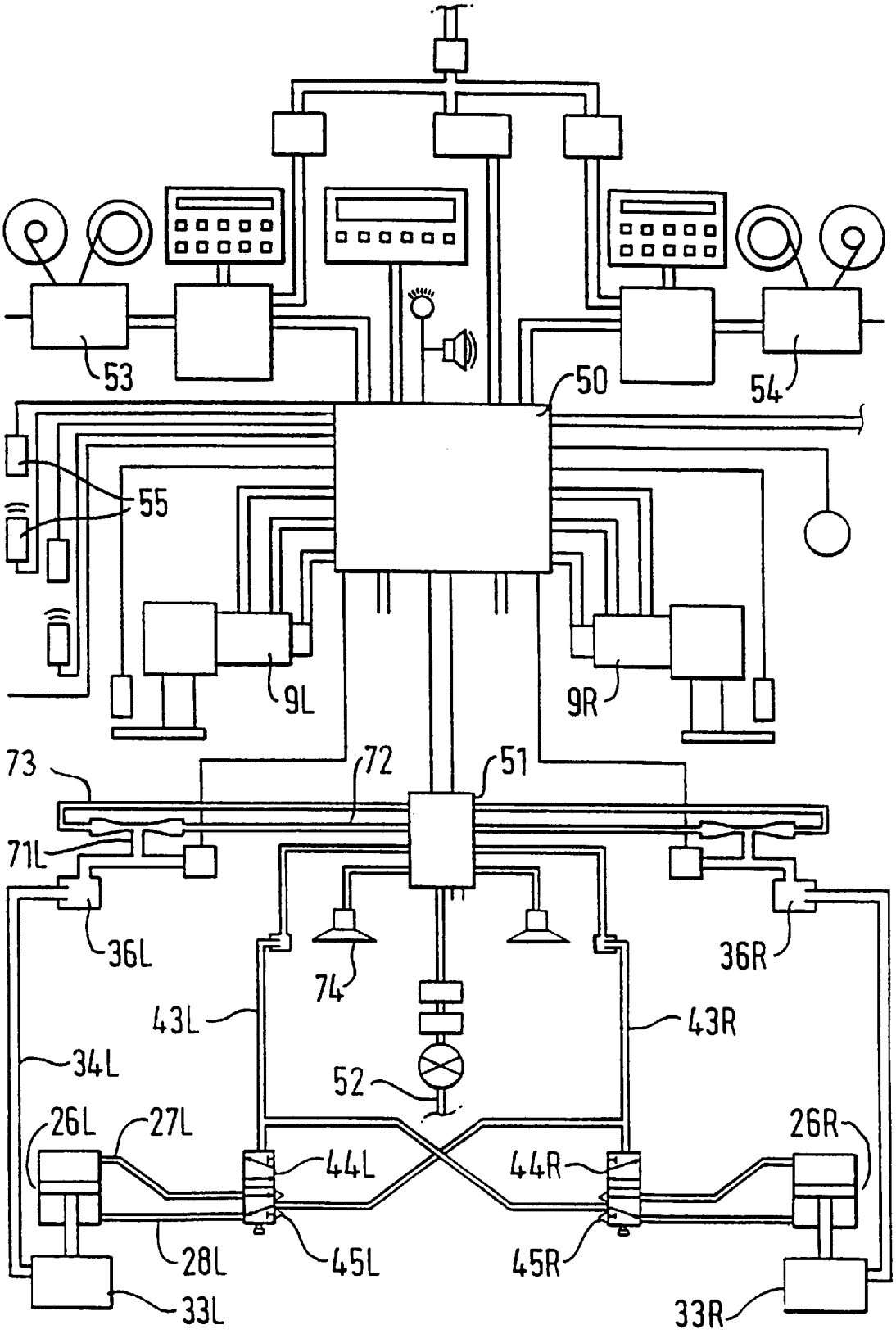
FIG. 7 shows diagrammatically the electrical and pneumatic relationships of the apparatus.

The connector 42 is connected both to a line 43 leading to the control port of an air pilot valve 44 (FIG. 7) and to a port 45 of the air pilot valve 44 of the other arm.

Figures 6A, 6B, 6C, 6D, 6E, 6F, 6G, 6H, 6I, 6J, 6K, 6L:
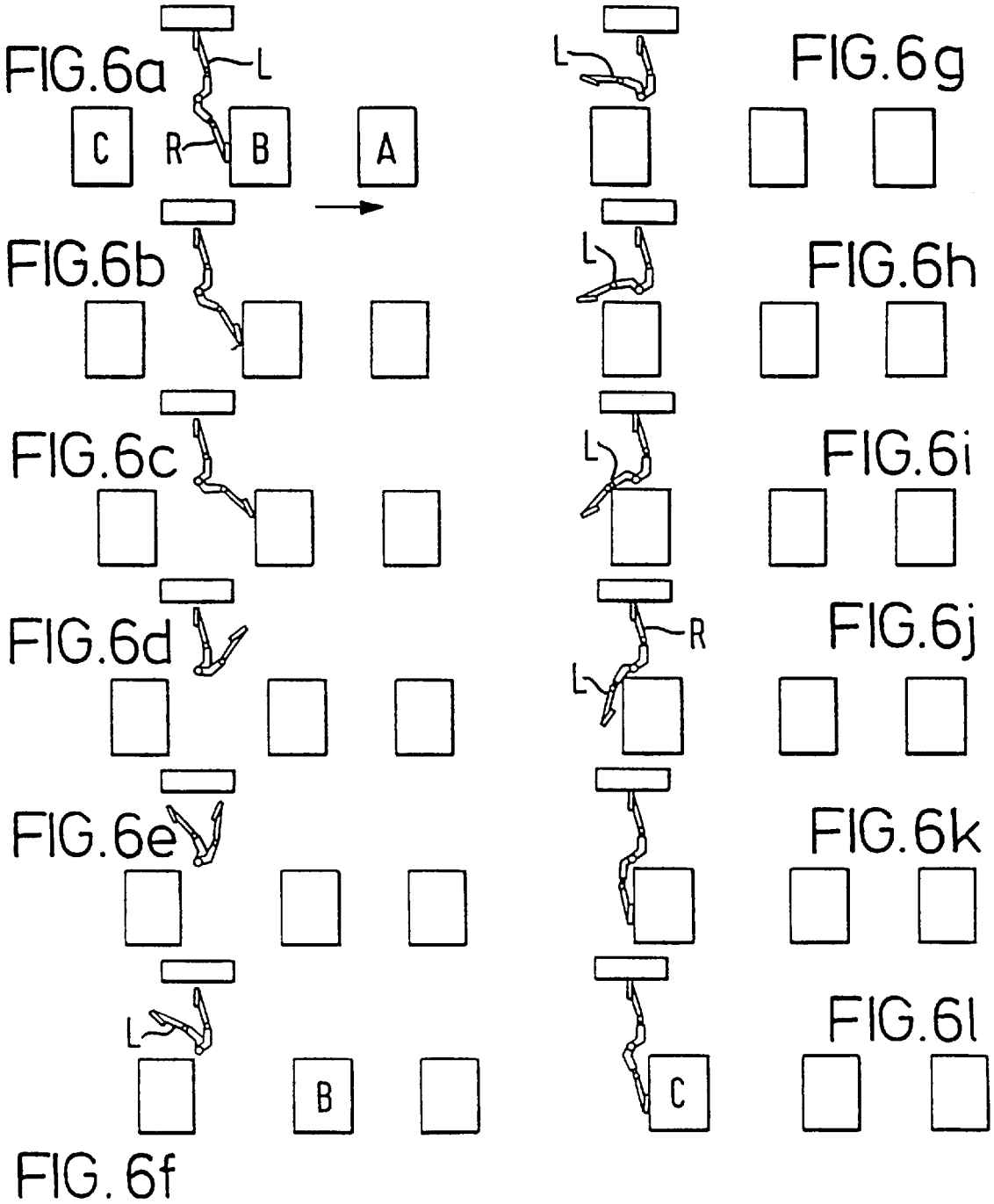
FIGS. 6*a* to 6*l* show 12 successive positions adopted by the arms of the apparatus during a cycle of collecting a label and applying it to a package.

During most of the revolution of an arm, a central controller 50 operates an assembly of solenoid operated valves 51 to control the supply of air from a compressed air inlet 52 so that both lines 43L and 43R are pressurized. The valves 44L and 44R then provide the connections shown in FIG. 7 so that both actuators 26 are retracted. When, however, one of the label supports is to collect a label from a printer 53 or 54, the controller 50 causes the relevant valve in the valve block 51 to depressurize the supply for example in the line 43L. The condition of the valve 44L then changes so that pressure is supplied from the line 43R to the connection 27L to cause the actuator 26L to extend the pad 33L (FIG. 6*a*). Thereafter, the controller 50 causes air pressure to be resupplied to the line 43L which causes the valve 44L to vent the port 27L and repressurize the port 28L to retract the pad 32L (FIGS. 6*b* to 6*d*).

Operation of the printers 53 or 54 and the valves 51 as well as speed control of the motors 9 is controlled by the controller 50 in response to photoelectric sensors 55 which register and identify the trailing edge of each package A, B, C as it passes.

When the arm L reaches the positions shown in FIG. 6*k* and 6*l*, the label carried by the pad 33 is brought into contact firmly with the rear surface of the package C and the motor 9L is caused to supply sufficient torque to flex the arm L and, also, if the package is somewhat skewed on the conveyor, to turn the pad 33 in flat engagement with the package about the bolt 30 against the action of a helical torsion spring 60.

Figure 3:
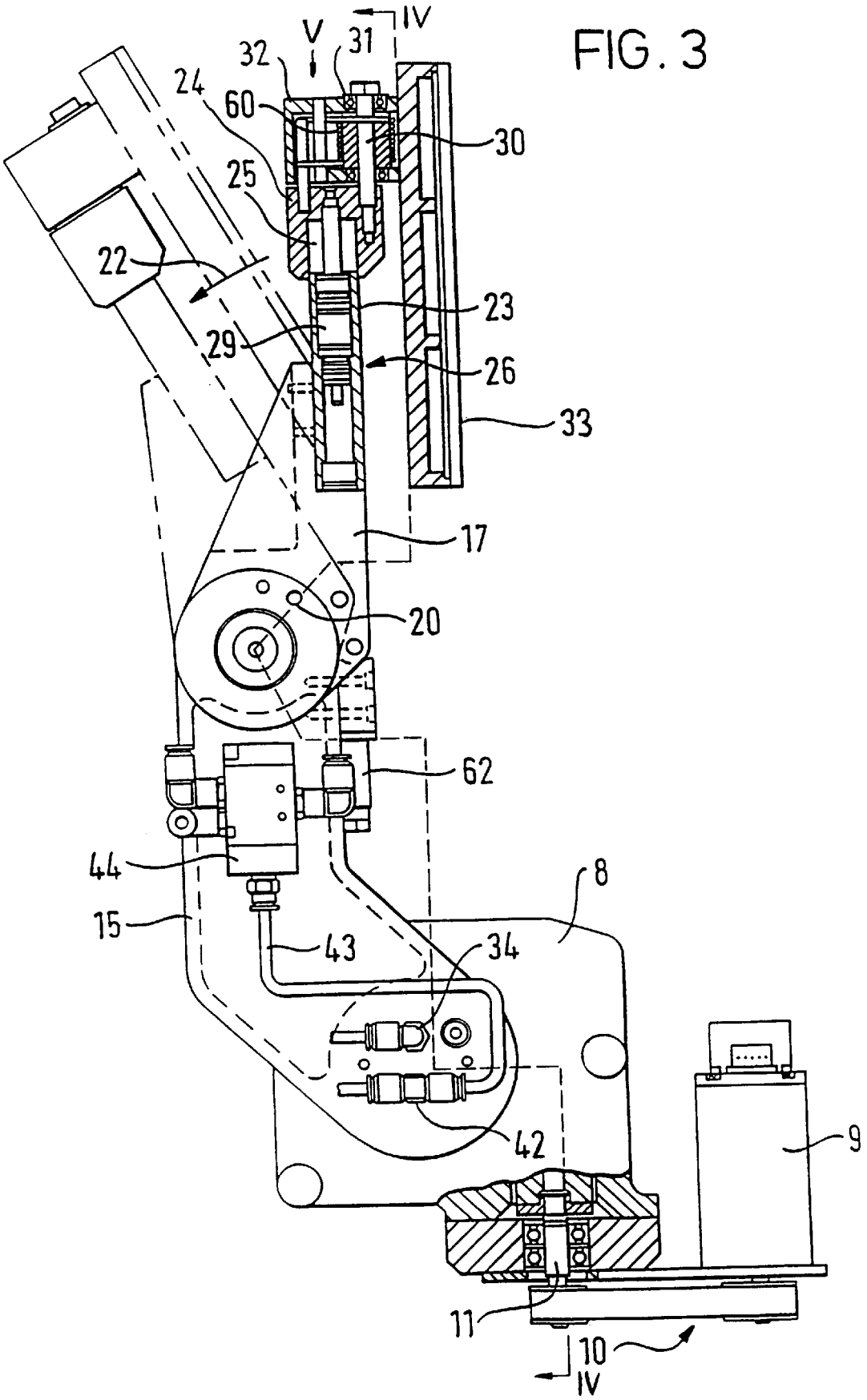
FIG. 3 shows one arm of the apparatus on an enlarged scale, in side elevation.
Figure 4:
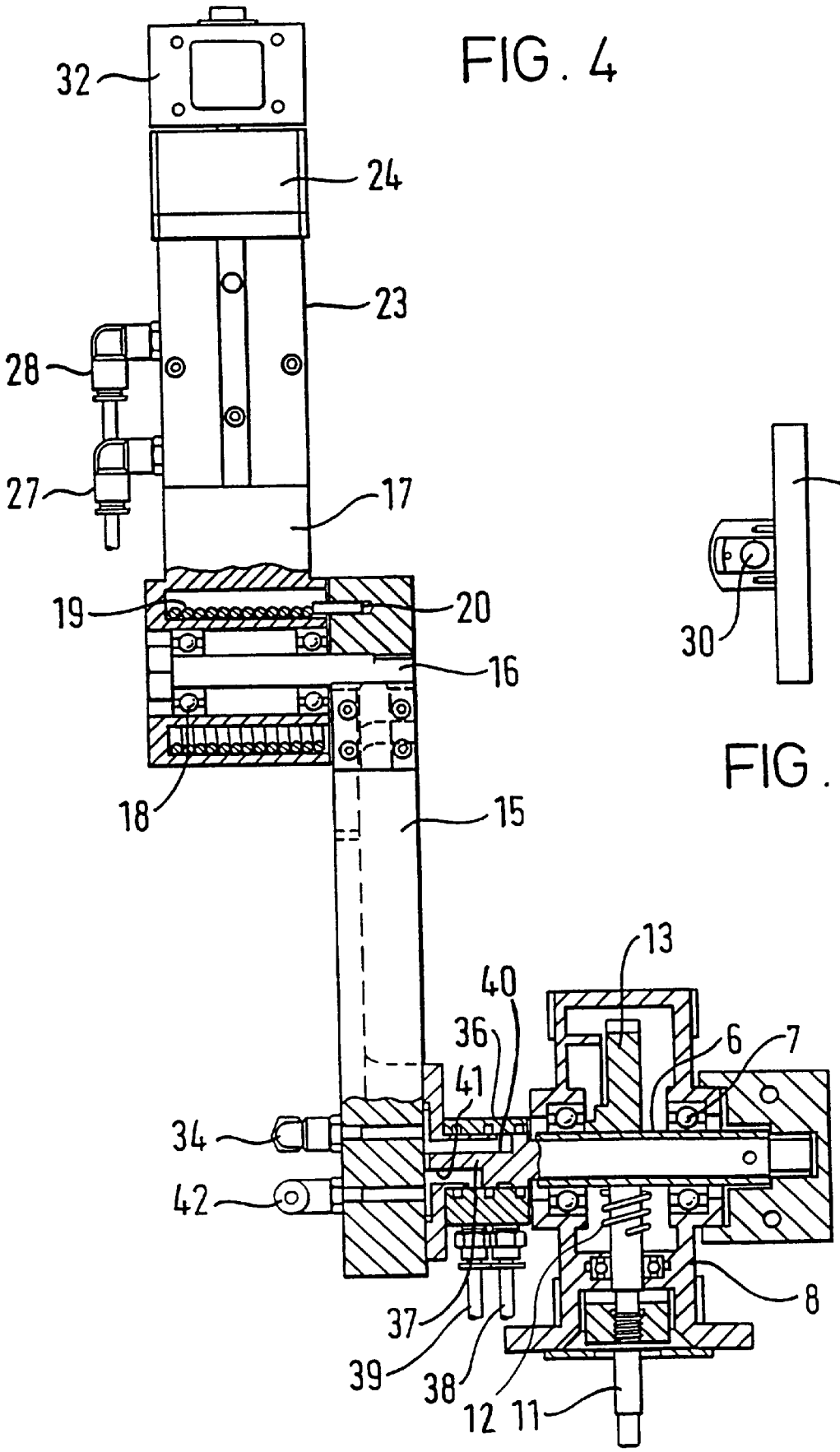
FIG. 4 is a sectional view on the line IV—IV of FIG. 3.
Figure 5:
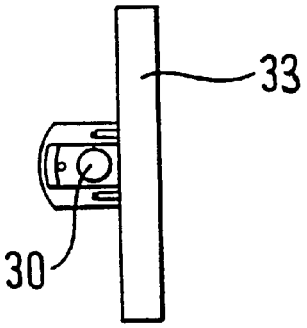
FIG. 5 is an end-view of the arm in the direction of the arrow V of FIG. 3.

When the package B to which the label has just been applied by the arm R moves away from the pad 33, as shown in FIGS. 6*b* to *d*, the outer arm 17 can return from the position shown in broken lines in FIG. 3 to the position shown in solid lines. To prevent excessive shock, a dashpot-type damper 62 is preferably mounted on the inner arm 15.

Suction for each of the pads 33 L, R is created by a venturi 71 through which air is blown via a line 72 from one of the valves in the block 51. To release a label, further air is supplied, through a line 73 from another of the valves in the block 51, to the opposite end of the venturi.

An air knife 74 may be used to assist the suction pads in removing labels from the printer(s) 53, 54.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. Apparatus for applying adhesive-carrying labels to a rear surface of articles which are moved past the apparatus, comprising an articulated arm having an inner and an outer arm portion and being mounted for unlimited rotation about an axis transverse to the direction of movement of the articles, a label support disposed on the outer arm portion of the arm for releasably supporting a label and carrying the label along a path to bring the label into contact with an article to be labelled, the inner and outer arm portions of the arm being resiliently biased towards a generally straight configuration but said outer arm portion being resiliently yieldable and pivotable with respect to said inner arm portion when applying a label to a rear surface of an article.

2. Apparatus according to claim 1 for use with self-adhesive labels carried by a release tape at a supply point wherein the arm is extendible and has means for extending the label support to collect a label at the supply point and then to retract the label support clear of the supply point.

3. Apparatus according to claim 2, wherein the apparatus includes a printer adjacent the supply point for printing indicia on the labels.

4. Apparatus according to claim 3, wherein the extending means comprises a pneumatic actuator supplied through rotary joints on the axis of rotation of the arm.

5. Apparatus according to claim 1, wherein the apparatus includes two of said arms mounted for rotation about a common axis and arranged to alternate in collecting and applying labels.

6. Apparatus according to claim 1, wherein the label support holds successive labels by suction applied via a rotary connection at the axis of rotation of the arm, which suction is released or replaced by positive pressure as the label is applied to an article.

7. Apparatus according to claim 1 for use with self-adhesive labels carried by a release tape at a supply point wherein the arm is extendible and has means for extending the label support to collect a label at the supply point and then to retract the label support clear of the supply point.

8. Apparatus for applying adhesive-carrying labels to articles which are moved past the apparatus comprising an arm mounted for unlimited rotation about an axis transverse to the direction of movement of the articles, a label support on the arm for releasably supporting a label and carrying the label along a path to bring the label into contact with an article to be labelled, the label support being yieldably mounted relative to an inner part of the arm, the apparatus being usable with self-adhesive labels carried by a release tape at a supply point wherein the arm is extendible and has means for extending the label support to collect a label at the supply point and then to retract the label support clear of the supply point, and further wherein the extending means comprises a pneumatic actuator supplied through rotary joints on the axis of rotation of the arm.

9. Apparatus for applying adhesive-carrying labels to articles which are moved past the apparatus comprising an arm mounted for unlimited rotation about an axis transverse to the direction of movement of the articles, a label support on the arm for releasably supporting a label and carrying the label along a path to bring the label into contact with an article to be labelled, the label support being yieldably mounted relative to an inner part of the arm, wherein the apparatus includes two of said arms mounted for rotation about a common axis and arranged to alternate in collecting and applying labels, wherein said two arms are a first arm and a second arm, said first arm carrying a first two-position pilot valve responsive to a first supply of pressurized air connected to the first pilot valve via a first rotary joint, said second arm carrying a second two-position pilot valve responsive to a second supply of pressurized air connected to the second pilot valve via a second rotary joint, said first supply being connected by a first flexible conduit to the second pilot valve, and said second supply being connected by a second flexible conduit to the first pilot valve wherein when both of the first and second supplies are pressurized, both label supports are retracted, but when one of the first and second supplies is depressurized, the corresponding one of said first and second pilot valves operates to apply pressure from the other of said first and second supplies to extend the label support corresponding to said one of said first and second supplies.

10. An apparatus for applying adhesive-carrying labels to a rear surface of an article moved past said apparatus by means of a conveyor defining a direction of movement, said apparatus comprising:

an arm rotatably mounted about an axis of rotation transverse to the direction of movement, said arm being articulated and including an inner arm portion disposed adjacent the axis of rotation and an outer arm portion having an inner end pivotably associated with an outer end of said inner arm portion;

a label support disposed at an outer free end of said outer arm portion configured to releasably support a label thereon; and biasing means associated with said inner and outer arm portions to pivotably bias said outer arm portion in a first direction with respect to said inner arm portion, said outer arm portion being pivotable in a second direction opposite said first direction and against the biasing force of said biasing means so as to be resiliently yieldable upon abutment of said label support with the rear surface of the article.

11. The apparatus of claim 10 wherein said label support is pivotably mounted on said outer arm portion, said label support being pivotable about a pivot axis transverse to the axis of rotation upon abutment of said label support with the rear surface of the article to provide flat engagement of the label therewith.

12. The apparatus of claim 10 wherein said outer arm portion includes means for extending said label support towards a label supply at a label supply area and retracting said label support clear of the label supply area.

13. The apparatus of claim 12 wherein said extending and retracting means comprises a pneumatic actuator mounted on said outer arm portion, said apparatus further including a shaft mounted for rotation about the axis of rotation and a rotary connector nonrotatably connecting an inner end of said inner arm portion to said shaft, said rotary connector including a passage therein for supplying actuating fluid to said pneumatic actuator.

14. The apparatus of claim 10 wherein said apparatus includes two of said arms, said two arms being a first arm and a second arm, said first and second arms being mounted for rotation about a common rotational axis and arranged to alternatingly collect labels from a label supply and apply labels to the rear surface of the article.

15. The apparatus of claim 14 wherein said label supports of said first and second arms are extendible and retractable with respect to said outer arm portions thereof, said first and second arms having mounted thereon first and second two-position pilot valves, respectively, said first and second pilot valves each having a first position wherein the corresponding said label support is retracted and a second position wherein the corresponding said label support is extended, said first and second pilot valves being connected to respective first and second supply lines for providing pressurized fluid thereto, said first supply line also being connected to said second pilot valve via a first flexible conduit and said second supply line also being connected to said first pilot valve via a second flexible conduit such that upon both said first and second supply lines being pressurized said first and second pilot valves are in said first position, and upon one of said first and second supply lines being de-pressurized the corresponding one of said first and second pilot valves assumes said second position and operates to apply pressure from the other of said first and second supply lines to extend the corresponding said label support.

16. The apparatus of claim 15 further including a first shaft mounted for rotation about the axis of rotation and a first rotary connector nonrotatably connecting said inner arm portion of said first arm to said first shaft, a second shaft mounted for rotation about the axis of rotation and a second rotary connector nonrotatably connecting said inner arm portion of said second arm to said second shaft, said first pilot valve being connected to said first supply line via a passage disposed in said first rotary connector and said second pilot valve being connected to said second supply line via a passage disposed in said second rotary connector.

17. The apparatus of claim 10 wherein said label support is configured for providing air flow therethrough, said apparatus further including a shaft mounted for rotation about the axis of rotation and a rotary connector nonrotatably connecting said inner arm portion to said shaft, said rotary connector including a passage therein for supplying suction to said label support to hold a label thereon and for providing pressurized air to said label support to release the label therefrom during application of the label to the article.

* * * * *